US008550244B1

(12) United States Patent
Ou

(10) Patent No.: US 8,550,244 B1
(45) Date of Patent: Oct. 8, 2013

(54) COMBINATION OF TOOL SUSPENSION STRUCTURE AND SOCKET

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 13/728,852

(22) Filed: Dec. 27, 2012

(51) Int. Cl.
*B65D 85/28* (2006.01)

(52) U.S. Cl.
USPC ..... 206/378

(58) Field of Classification Search
USPC ..... 206/372, 373, 376, 378
See application file for complete search history.

(56) References Cited

U.S. PATENT DOCUMENTS 6,364,109 B1 * 4/2002 Blackwell ..... 206/378
6,508,360 B1 * 1/2003 Chen ..... 206/378
6,669,032 B2 * 12/2003 Kao ..... 211/70.6
8,307,980 B1 * 11/2012 Kao ..... 206/378
2003/0024837 A1 * 2/2003 Chen ..... 206/378
2003/0070999 A1 * 4/2003 Kao ..... 211/70.6
2003/0102275 A1 * 6/2003 Kao ..... 211/70.6
2005/0121344 A1 * 6/2005 Chang ..... 206/378
2010/0170817 A1 * 7/2010 Wu ..... 206/378

* cited by examiner

*Primary Examiner* — Jacob K Ackun

(57) ABSTRACT

A tool suspension structure of the present invention is adapted for displaying a socket which forms holes at two opposite ends respectively. The tool suspension structure includes a main body and an engaging member which is detachably disposed to the main body. The main body has a plurality of first fixing elements adapted for inserting into the holes of the socket, and the engaging member has a plurality of second fixing elements adapted for inserting into the hole of the socket. The socket is able to be fixed and secured. Besides, a ratio of a length of the second fixing element inside the hole of the socket to a length of the hole is 0.3 to 0.6. Thus, structure strength and material amount can be balanced.

9 Claims, 3 Drawing Sheets

COMBINATION OF TOOL SUSPENSION STRUCTURE AND SOCKET

BACKGROUND OF THE INVENTION

1. Field of the Invention

The present invention relates to a combination of tool suspension structure and socket.

2. Description of the Prior Art

A conventional suspension structure for displaying sockets usually includes a frame, a plurality positioning elements, a plurality of tool pieces, a connecting element, and a plurality of fixing members. The frame forms a track portion, and each positioning element has a sliding slot slidably disposed to the track portion. Each positioning element has a positioning portion at another end, and the positioning portion forms a protruding rod. The protruding rod has a first fixing portion. Each tool piece is disposed to one of the positioning portion. The connecting element has a plurality of connecting ends, and each connecting end forms second through slot. The second through slot is sleeved onto the protruding rod. Each fixing member forms a conical face at an end, and the conical face protrudingly forms a second fixing portion which is tetragonal and has two toothed-hook-shaped side faces. When the fixing member is pressed, the second fixing portion is connected to the first fixing portion, and the fixing end is unable to separate from the protruding rod due to the conical face. Thus, the connecting element is connected to the positioning element to secure the tool pieces.

SUMMARY OF THE INVENTION

The main object of the present invention is to provide a tool suspension structure for displaying and securing sockets.

To achieve the above and other objects, a tool suspension structure of the present invention adapted for displaying a socket which forms a first hole and a second hole at two opposite ends thereof along an axial direction includes a main body and an engaging member.

The main body has a suspension portion at an end and an engaging portion at a side. The engaging portion has a plurality of first fixing elements arranged along a first direction, and each first fixing element is adapted for inserting into the first hole of the socket and abutting against the socket. The main body has a first connecting portion and a second connecting portion at two sides of the first fixing elements along the first direction. The engaging member has a third connecting portion at an end and a fourth connecting portion at an opposite end. The third connecting portion is detachably disposed to the first connecting portion, and the fourth connecting portion is detachably disposed to the second connecting portion. The engaging member and the main body enclose a space for receiving the socket. The engaging element has a plurality of second fixing elements arranged in a fashion corresponding to the first fixing elements. Each second fixing portion is adapted for inserting into the second hole of the socket and abutting against the socket. Specifically, a first length is defined by a length of the second fixing element inserting into the second hole, and a second length is defined by a width of the second hole along the axial direction of the socket. The ratio of the first length to the second length is 0.3 to 0.6.

Thereby, the socket can be firmly positioned by the first fixing element and the second fixing element. Also, structure strength and material cost can be balanced well due to the specific ratio of the first length to the second length.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
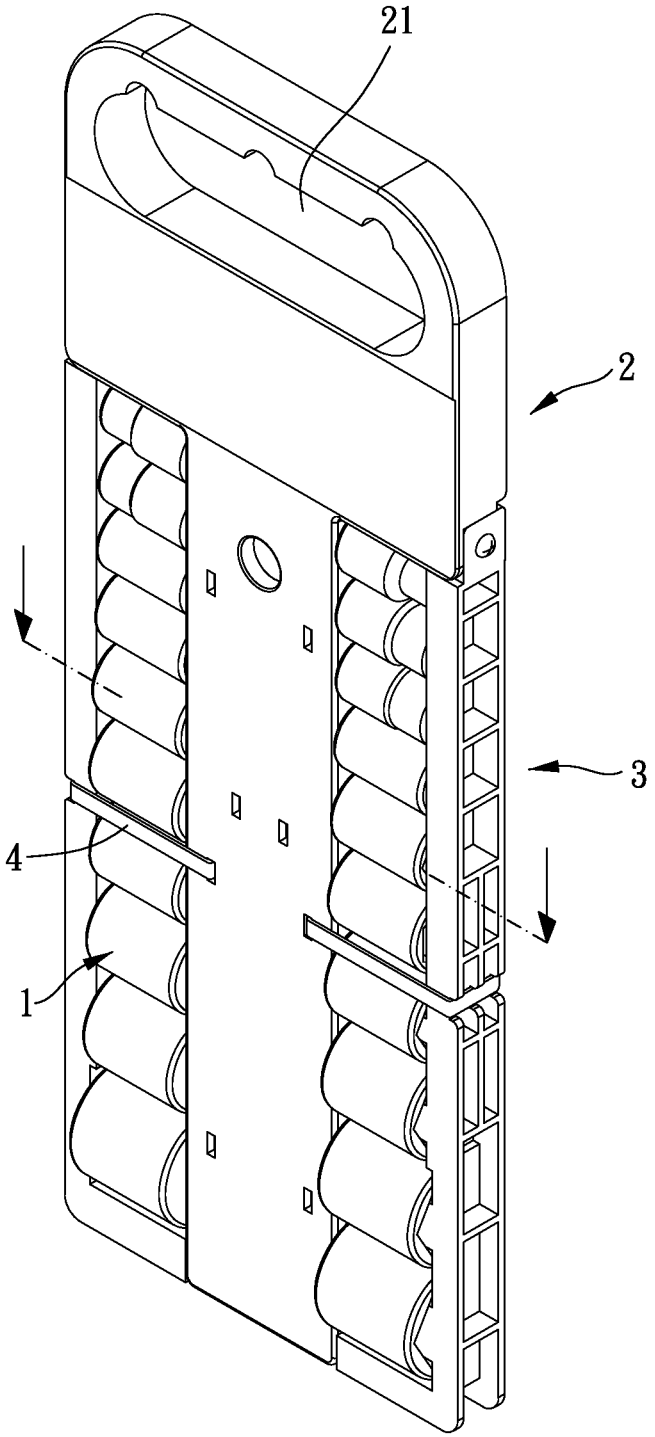
FIG. 1 is a stereogram of the present invention.
Figure 2:
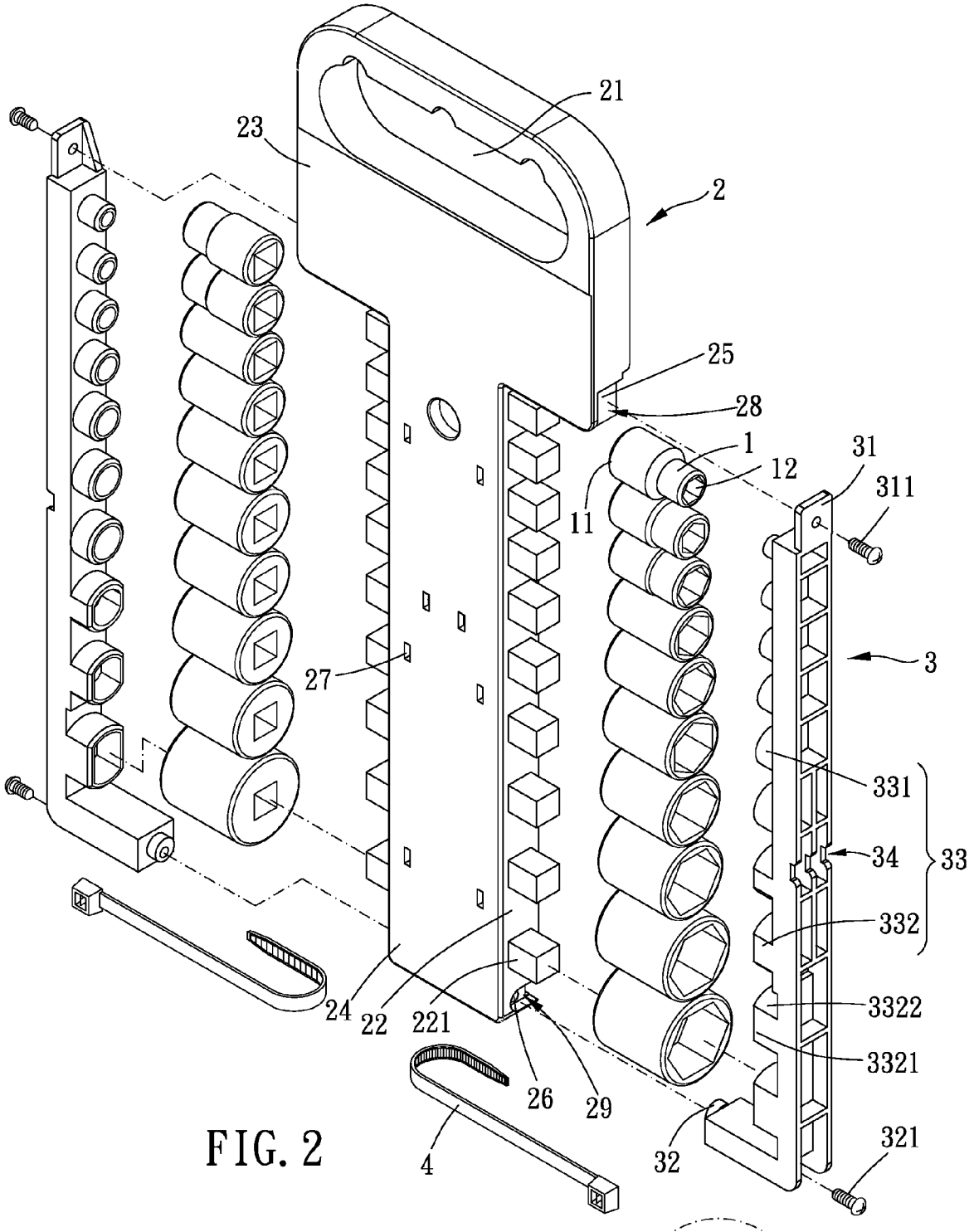
FIG. 2 is a breakdown drawing of FIG. 1.

Please refer to FIG. 1 and FIG. 2, the tool suspension structure of the present invention is adapted for displaying a socket 1 which forms a first hole 11 and a second hole 12 at two opposite ends along an axial direction of the socket 1. In the present invention, the first hole 11 is a tetragonal hole, and the second hole 12 is a hexagonal hole. However, other shapes of holes can be formed as the first hole and the second hole. The tool suspension structure of the present invention includes a main body 1 and two engaging members 3.

The main body 2 has a suspension portion 21 at an end and engaging portions 22 at two sides of an opposite end. In the present embodiment, the suspension portion is hollow-bored, but the suspension portion can be a hook or other types in other possible embodiments. The main body 2 is substantially T-shaped and has a first portion 23 and a second portion which has a relatively smaller width. The suspension portion 21 is located at the first portion 23, and the engaging portion 22 is located at one side of the second portion 24. Each engaging portion 22 has a plurality of first fixing elements 221 arranged along a first direction. Each first fixing element 221 is adapted for inserting into the first hole 11 of the socket 1 and abutting against the socket 1 so that the socket 1 is positioned. In the present embodiment, the first fixing element 221 is substantially tetragonal-rod-shaped to correspond to the first hole 11 so that the socket 1 may not rotate with respect to the first fixing element 221. Moreover, the first fixing elements 221 are designed in different sizes to correspond to sockets in various sizes. In other possible embodiments, the first fixing element can be other shapes. The main body 2 has a first connecting portion 25 and a second connecting portion 26 at two sides of the first fixing elements along the first direction. Thus, each of the two sides of the main body 2 has a first connecting portion 25 and a second connecting portion 26. In the present embodiment, the first connecting portion 25 is located at the first portion 23 near the second portion 24, and the second connecting portion 26 is located at a terminal end of the second portion 24 away from the first portion 23.

Figure 2A:
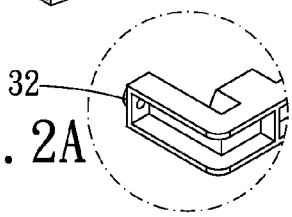
FIG. 2A is a partial enlargement showing an engaging member of the present invention.
Figure 3:
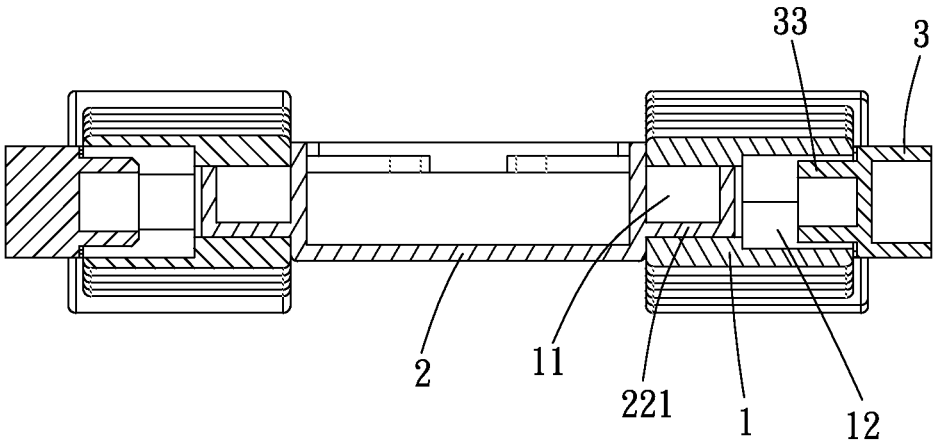
FIG. 3 is a profile FIG. 1.

Please refer to FIGS. 2, 2A, and 3. Each engaging member 3 is substantially L-shaped. The engaging member 3 has a third connecting portion 31 at an end and a fourth connecting portion 32 at another end. The third connecting portion 31 is detachably disposed to the first connecting portion 25 by a first insertion element 311 inserting therethrough. The fourth connecting portion 32 is detachably disposed to the second connecting portion 26 by a second insertion element 321 inserting therethrough. The engaging member 3 and the main body 2 enclose a space for receiving the socket. Besides, the engaging member 3 has a plurality of second fixing elements 33 arranged in a fashion corresponding to the first fixing elements 221. Each second fixing element 33 is adapted for inserting into the second hole 12 of the socket 1 and abutting against the socket 1. In the present embodiment, the second fixing elements 33 are various in sizes and shapes. Specifically, some smaller second fixing elements 331 are circular-rod-shaped and have diameters corresponding to the minimum diameter of the socket to insert in so that the second fixing element 331 can be positioned to the socket. Each of some second fixing elements 332 in bigger sizes has two opposite parallel faces 3321 and two arc faces 3322 connecting therebetween. When the second fixing element 332 is inserted into the second hole of the socket, the two arc faces 3321 are able to abut against inner wall of the second hole so that the second fixing element 332 is unable to rotate with respect to the socket. Besides, the parallel faces 3322 are designed to keep the engaging member 3 in a same width.

In use, when the socket 1 is to be disposed on the tool suspension structure, a user can take the first hole 11 of the socket 1 sleeved onto the first fixing element 221 and then take the second fixing element 33 inserting into the second hole 12. Thereafter, the engaging member 3 is positioned to the main body 2. Thus, when a plurality of sockets are to be positioned, a user can take each socket sleeved onto one of the second fixing element first and then connect the engaging member to the main body.

Besides, in the present embodiment, the first connecting portion 25 is solid and is adapted for being drilled and screwed by the first insertion element 311, so the first insertion element 311 is inserted through the third connecting portion 31 into the first connecting portion 25. The second connecting portion 26 is also solid and is drilled and screwed by the second insertion element 321. Thereby, fixation strength of the first fixing element and the second fixing strength is enhanced by the solid structure of the first connecting portion and the second connecting portion, so the first and the second fixing elements may not be detached under forces. Thus, the entire structure strength of the tool suspension structure is promoted.

Moreover, in the present embodiment, the engaging member 3 has an indentation 34 between the third connecting portion 31 and the fourth connecting portion 32 for a connecting member to be disposed around. The main body 2 forms a plurality of through holes 27. Preferably, the through holes 27 are located between the first connecting portion 25 and the second connecting portion 26. Thereby, when the engaging member 3 has been disposed to the main body 2, the connecting member 4 such as a band can be sleeved onto the indentation 34 and through the through hole 27. Thus, the engaging member 3 can be fixed to the main body 2 more firmly. Alternatively, the connecting member can be a wire for being tied onto the indentation and through the through hole.

Furthermore, in the present embodiment, the main body 2 forms a recess 28 near the first connecting portion 25. When the engaging member 3 is to be disposed to the main body 2, the third connecting portion 31 is located in the recess 28 and is able to be positioned to the first connecting portion 25 quickly. Also, a contact area between the main body 2 and the engaging member 3 is increased due to the recess 28 to prevent deformation. On the other hand, the main body 2 alternatively has a notch 29 near the second connecting portion 26. The fourth connecting portion 32 is inserted into the notch 29 and connected with the second connecting portion 26 quickly.

Besides, a first length is defined by a length of the second fixing element inserted into the second hole of the socket, and a second length is defined by a depth of the second hole along the axial direction of the socket. A ratio of the first length to the second length is about 0.3 to 0.6. Within this range of ratio, the socket can be fixed to the second fixing element firmly. Also, cost of material can be reduced as possible.

What is claimed is:

1. A combination of tool suspension structure and socket including a tool suspension structure and at least one socket wherein the at least one socket forms a first hole and a second hole at two opposite ends along an axis thereof, the tool suspension structure including:

a main body, having a suspension portion at an end, an engaging portion being formed at a side of the main body, the engaging portion including a plurality of first fixing elements arranged along a first direction, each first fixing element being adapted for inserting into the first hole and abutting against the socket, the main body having a first connecting portion and a second connecting portion beside two opposite ends of the first fixing elements along the first direction;

an engaging member, having a third connecting portion and a fourth connecting portion at two opposite ends, the third connecting portion being detachably connected to the first connecting portion, the fourth connecting portion being protruded and detachably connected to the second connecting portion, the engaging member and the main body enclosing a space for receiving the socket, the engaging member forming a plurality of second fixing elements arranged corresponding to the first fixing elements, each second fixing element being adapted for inserting into the second hole and abutting against the socket, a first length being defined by a length which the second fixing element inserts into the second hole, a second length being defined by a depth of the second hole along the axis of the socket, a ratio of the first length to the second length being 0.3 to 0.6;

wherein the main body forms a notch near the second connecting portion, the fourth connecting portion is inserted into the notch and is connected with the second connecting portion, the second connecting portion and the fourth connecting portion are connected by a second insertion element inserting therethrough.

2. The combination of tool suspension structure and socket of claim 1, wherein the main body has a first portion and a second portion which has a relatively smaller width, the first portion has the suspension portion, the engaging portion is located at a side of the second portion.

3. The combination of tool suspension structure and socket of claim 2, wherein the first portion of the main body has the first connecting portion, the second connecting portion is located at an end of the second portion.

4. The combination of tool suspension structure and socket of claim 1, wherein the first connecting portion and the third connecting portion are connected by a first insertion element inserting therethrough.

5. The combination of tool suspension structure and socket of claim 4, wherein the first connecting portion is solid and is adapted for being drilled and fixed by the first insertion element.

6. The combination of tool suspension structure and socket of claim 1, wherein the second connecting portion is solid and is adapted for being drilled and fixed by the second insertion element.

7. The combination of tool suspension structure and socket of claim 1, wherein the engaging member forms an indentation between the third connecting portion and the fourth connecting portion for a connecting member to be disposed around, the main body has at least one through hole for the connecting member to insert in.

8. The combination of tool suspension structure and socket of claim 1, wherein the main body forms a recess near the first connecting portion, the third connecting portion is disposed in the recess and is connected with the first connecting portion.

9. The combination of tool suspension structure and socket of claim 1, wherein the engaging member is substantially L-shaped.

* * * * *